US006347811B1

(12) United States Patent
Bianco et al.

(10) Patent No.: US 6,347,811 B1
(45) Date of Patent: Feb. 19, 2002

(54) STRUCTURE OF A DIARY OF HIGH PRACTICALITY OF USE

(75) Inventors: Emilio Bianco, Venaria Reale; Giuliano Cugola, Bergamo, both of (IT)

(73) Assignees: Nuovo Istituto Italiano D-ArtiGrafiche (IT); 757120 Ontario Ltd. (CA)

( * ) Notice: Subject to any disclaimer, the term of this patent is extended or adjusted under 35 U.S.C. 154(b) by 0 days.

(21) Appl. No.: 09/219,796

(22) Filed: Dec. 23, 1998

(Under 37 CFR 1.47)

(51) Int. Cl.[7] ..... B42D 5/04

(52) U.S. Cl. ..... 283/2; 283/3; 283/4; 283/36; 283/38; 283/42; 281/2; 281/5

(58) Field of Search ..... 283/4, 3, 2, 36, 283/38, 42; 281/2, 5

(56) References Cited

U.S. PATENT DOCUMENTS

| | | | | |
|---|---|---|---|---|
| 1,161,580 A | * | 11/1915 | Allen | |
| 1,204,331 A | * | 11/1916 | Annanble | |
| 5,016,917 A | * | 5/1991 | Dubner et al. | 283/4 |
| 5,234,231 A | * | 8/1993 | Hollander et al. | 281/2 |
| 5,333,908 A | * | 8/1994 | Dorney et al. | 283/38 |
| 5,538,288 A | * | 7/1996 | Heath | 283/2 |
| 5,725,252 A | * | 3/1998 | Crum et al. | 283/34 |
| 5,782,494 A | * | 7/1998 | Crandall et al. | 281/2 |

* cited by examiner

*Primary Examiner*—A. L. Wellington
*Assistant Examiner*—Alisa Thurston
(74) *Attorney, Agent, or Firm*—Fredrikson & Byron, PA

(57) ABSTRACT

Structure of diary of high practicality of use, characterized by the fact of comprising weekly modules, bound together, each one constituted of a page; sub-divided into two parts, which have note space structured in a weekly and daily manner; in addition, each module comprising supplementary portions, bound with the above mentioned parts in such a way as to define further daily note space, superimposable on the internal and external zones of those parts.

4 Claims, 4 Drawing Sheets

STRUCTURE OF A DIARY OF HIGH PRACTICALITY OF USE

FIELD OF THE INVENTION

This invention relates to the structure of a diary of high practicality of use.

BACKGROUND TO THE INVENTION

The diaries which are currently available on the market may be practically sub-divided into two principal categories: the so-called "daily" diaries and the so-called "weekly" diaries.

In the daily diaries, each page carries, on one of its sides, a day of the year, with the related space for notes. Some types of daily diaries carry, on the same said of the page, two days which occupy half of the page, such as Saturday and Sunday. Usually, for the latter, not being working days, there is less need for notes.

The weekly types of diaries are generally structured so as to present, on the sides of two adjacent pages, columns which flank each other, each one marked with the day of the year, in such a way as to accommodate on those two sides to the pages concerned the days of an entire week.

Daily diaries present the inconvenience of not permitting the immediate visualization of a full week's commitments and, therefore, do not enable the user to have available the notes of a single day, immediately taking into account the commitments made on the previous day or for succeeding days of the same week.

In contrast, the weekly diaries permit the global visualization of the current week. However, weekly diaries present the inconvenience of having significantly reduced note space, compared to the space available for the purpose in the daily diaries.

BRIEF SUMMARY OF THE INVENTION

An object of an aspect of this invention is that of obviating or reducing the inconveniences stated above, creating a diary able to unite the advantages of a daily-type diary with those typical of a weekly-type diary.

In line with the above stated object, a particular aspect of this invention is that of achieving a diary structure in such a way as to provide the user with a comprehensive view of the week taking place and, at the same time, to offer the user a substantial space for the notes of every single day.

Another aspect of this invention is that of creating a diary which is structurally compact, has a uniform thickness and can be produced at competitive cost.

Aspects stated above, as well as the purposes already mentioned and others which will subsequently be indicated, are achieved by a structure of diary characterized by the fact of including weekly modules bound together, each one constituted of a page, sub-divided into two parts, which carry note space in a weekly manner and space for daily notes. In addition, each module includes added portions bound with the above mentioned parts in such a way as to define ulterior space for daily notes, superimposable by zone on the internal face and external face of the same.

Additional characteristic and advantages of the structure of the diary, which constitutes an object of aspects of this invention will, to a great extent, be evidenced through the examination of the detailed description of this diary.

BRIEF DESCRIPTION OF THE DRAWINGS

The present invention is illustrated, but not in a limiting way, with the help of embodiments shown in the attached drawings in which.

DETAINED DESCRIPTION OF THE INVENTION

Figure 2:
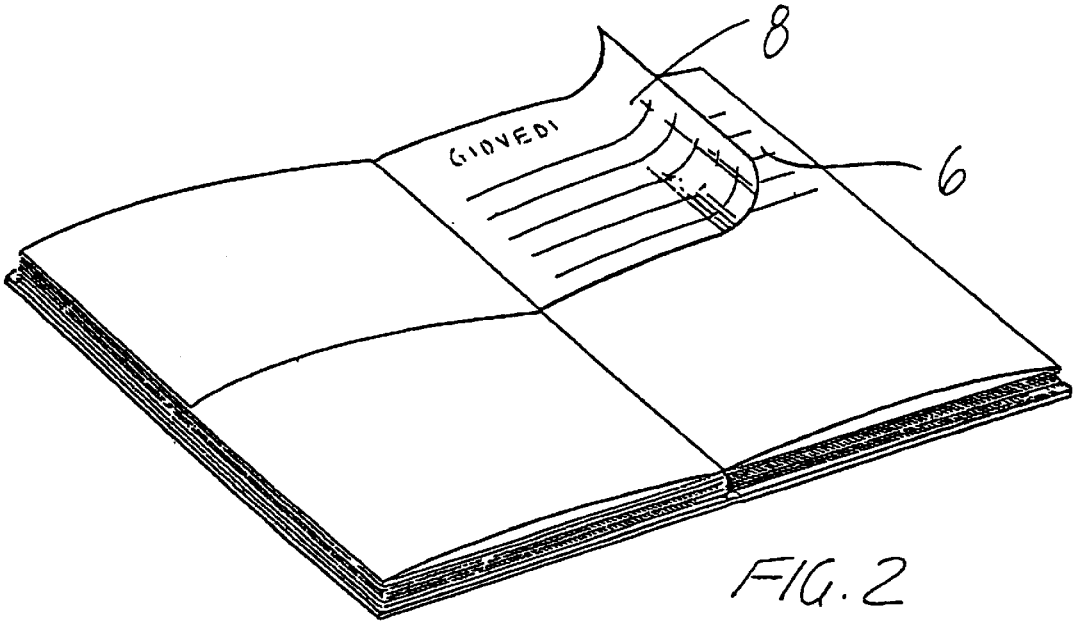
FIG. 2 illustrates the diary according to the invention, in perspective, open and clearly showing the external faces of two daily modules adjacent to each other.
Figure 1:
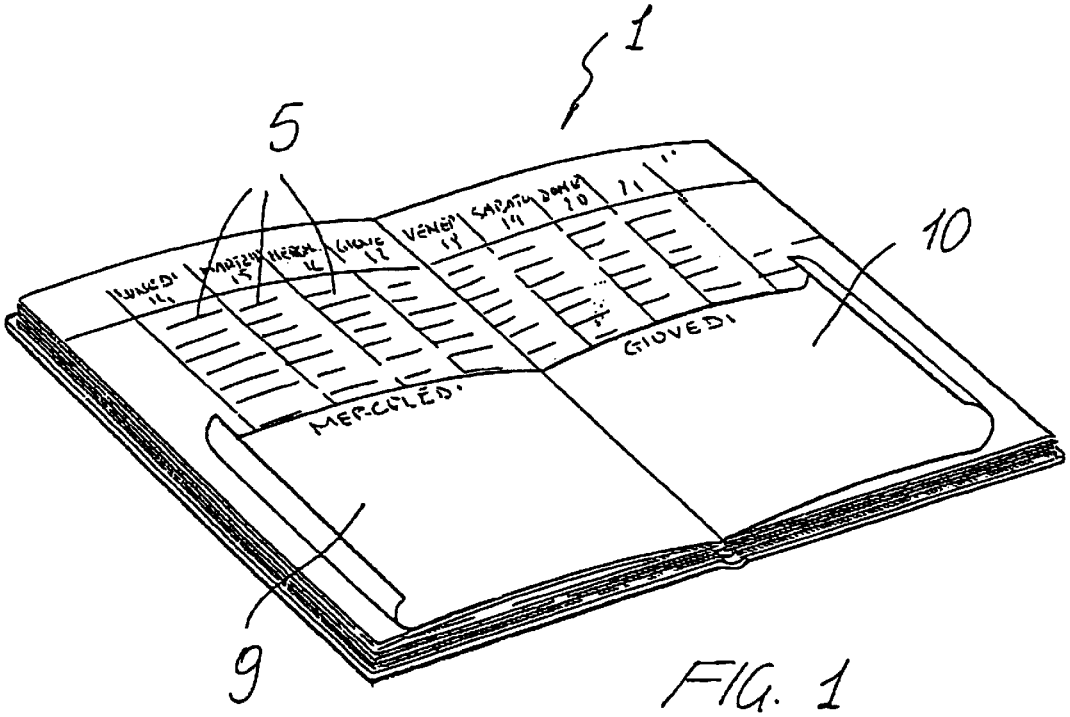
FIG. 1 illustrates, in perspective, the diary which has been invented, open and clearly showing the internal faces of one of the weekly modules.
Figure 3:
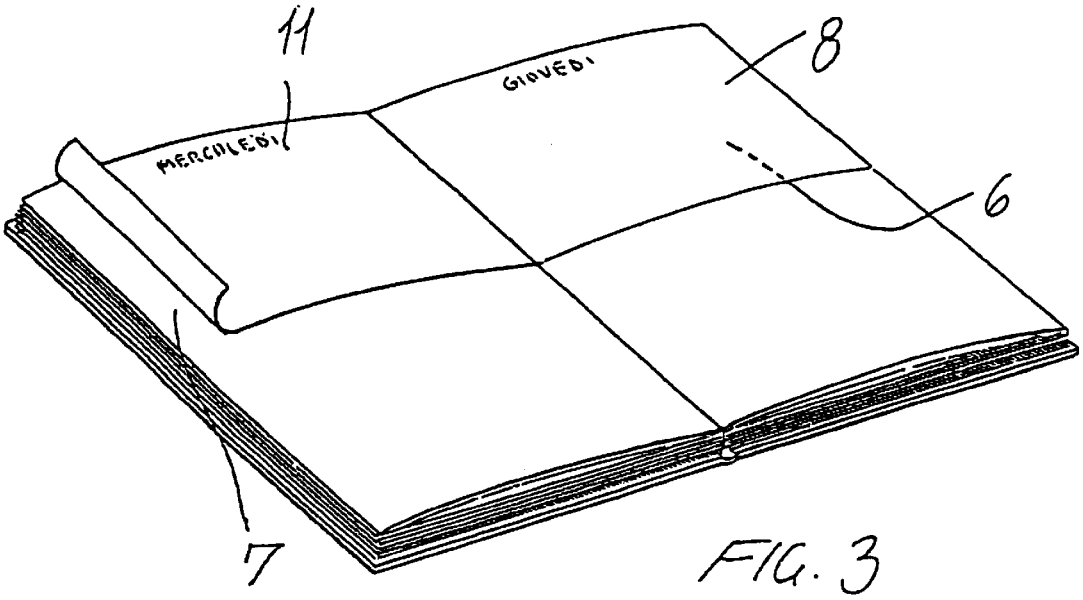
FIG. 3 illustrates the diary, according to the invention in perspective, open to place in evidence again the external faces of two adjacent daily modules.
Figure 4:
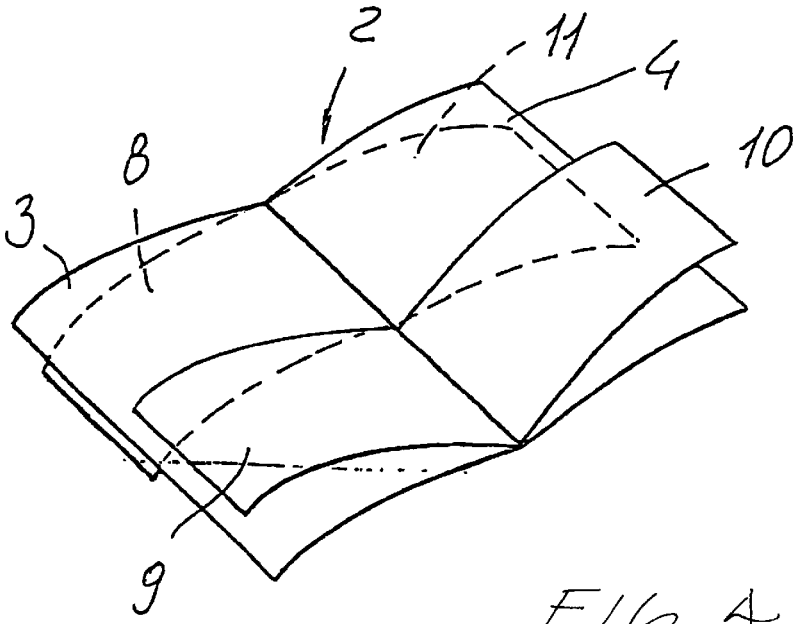
FIG. 4 illustrates, in perspective, one of the weekly modules which make up the diary, according to the invention.

With particular reference to the numeric symbols of the above mentioned FIG. 1, the diary, according to this invention, globally indicated at reference number 1, comprises weekly modules 2 that they are bound together. Each one is constituted of two parts 3 and 4 of a single page and those parts carry in the upper area of their internal sides and in the lower on their external sides, or on the sides which, after the binding of the diary, are reciprocally face-to-face, space for notes 5 structured in a weekly manner, or sub-divided in a multiplicity of columns side-by-side, each marked with a day of the week.

On the external sides of parts 3 and 4, daily note spaces are provided higher up 6, 7, for the days Monday, Saturday and Sunday, where the latter two are grouped together and the internal sides of the same parts 3 and 4 that present lower down space for the notes of the same days obviously relative to another week.

In addition, each module 2 also includes added portions indicated with the reference numbers 8, 9, 10 and 11 which, bound with parts 3 and 4, provide further daily note space superimposable by zone on the internal and external sides of the above mentioned parts 3 and 4.

More particularly, part 3 of each module 2 is provided with an added portion 8 which is positioned after the binding in the upper zone of its external side and of another supplementary portion 9 which, after binding, is positioned in the zone below its internal side.

Analogously, part 4 of each module 2 is also provided with a supplementary portion 11, which is positioned in the zone above its external side, and another supplementary portion of page 10, which is positioned in the zone below its internal side.

The supplementary portions 8, 9, 10 and 11 are of a height which is substantially equal to half the height of the parts 3 and 4.

In this way, with the external sides above and the internal sides below the parts 3 and 4, and in addition with the two sides of the supplementary portions, 8, 9, 10 and 11, the user has available six daily notes spaces per week, each of which presents an extension equal to a side of the parts 3 and 4.

In practice, the supplementary portion 8 is used, with its two sides, for the notes of Thursday and Friday. Supplementary portion 9 is used on the two sides for the notes of Tuesday and Wednesday, while the supplementary portion 10 is used for the notes of Thursday and Friday. Finally, the portion of supplementary page 11 is used on both sides for the notes of Tuesday and Wednesday.

Figure 5:
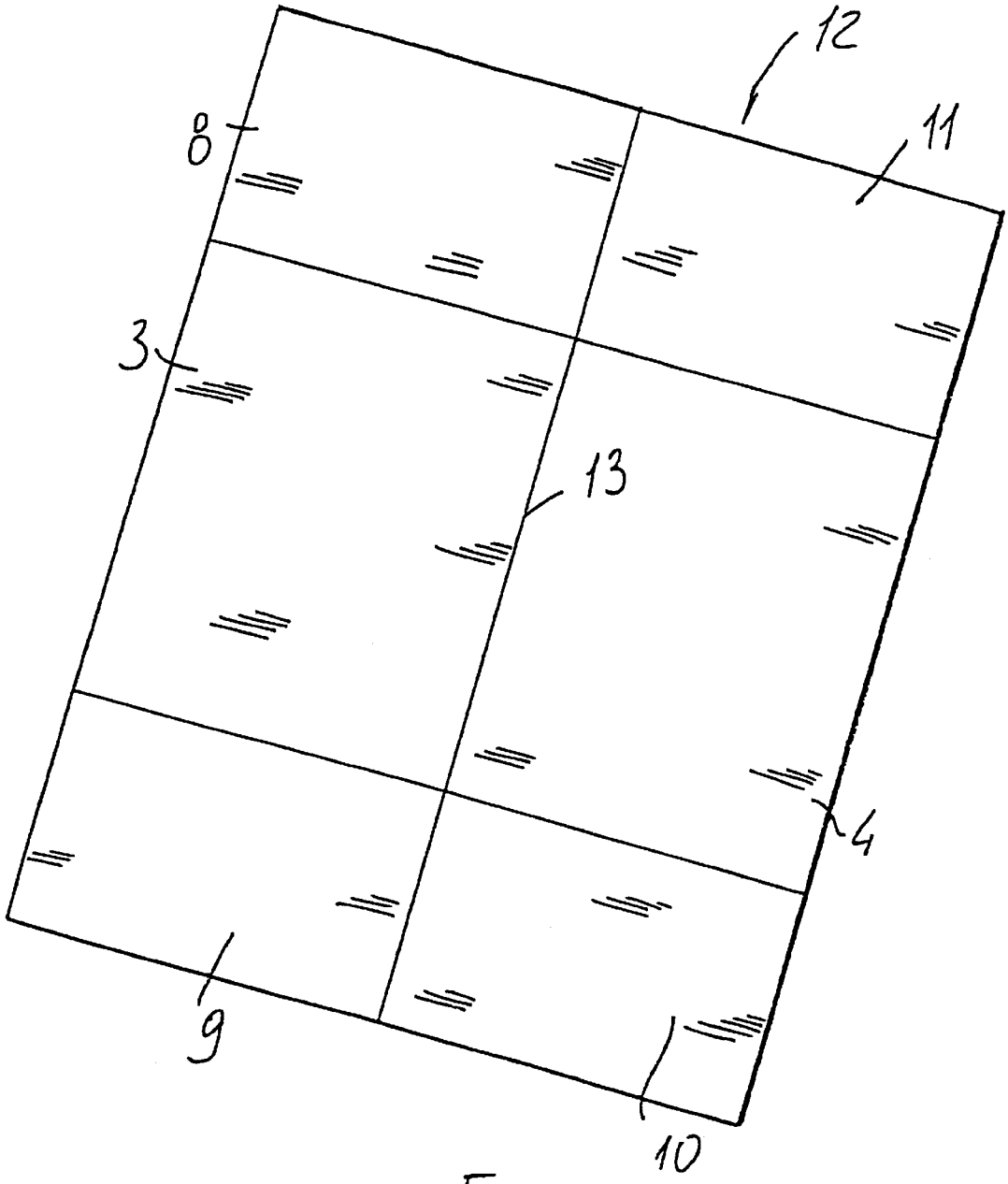
FIG. 5 illustrates a base page used in production of a weekly module of the diary of the invention.
Figure 6:
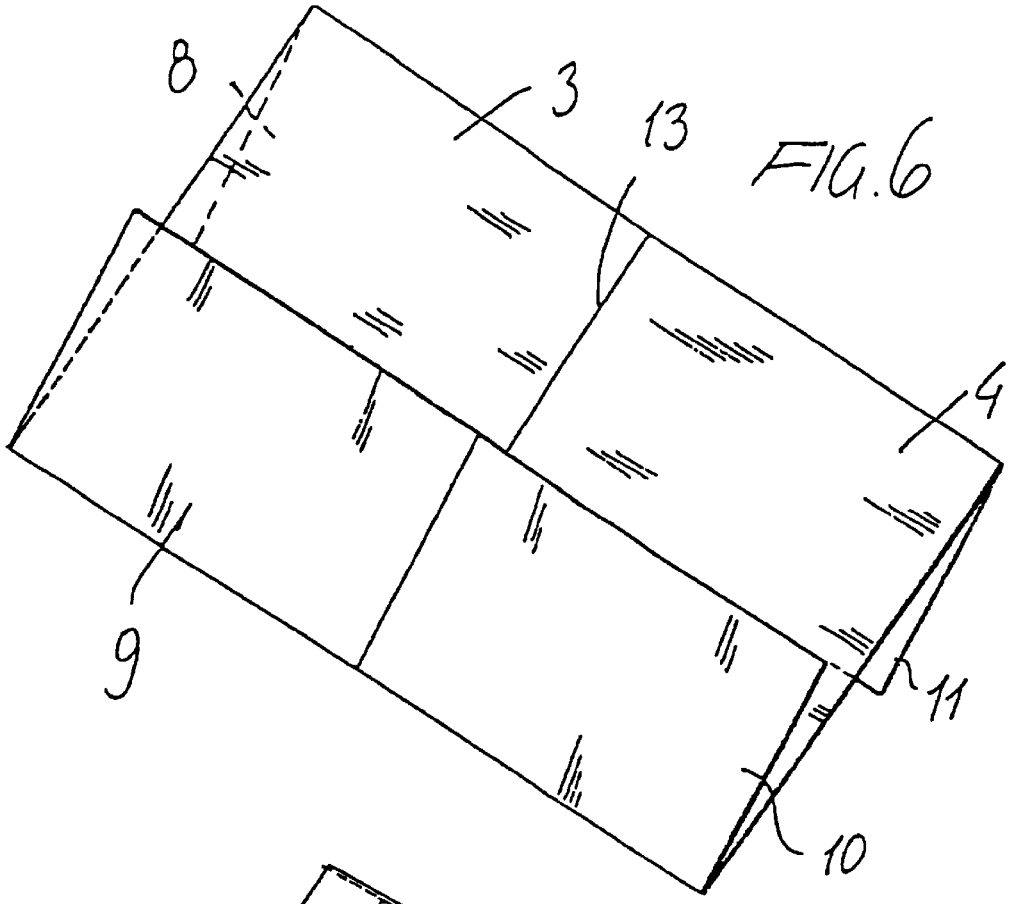
FIG. 6 illustrates the base page of FIG. 5 in a partially folded position.
Figure 7:
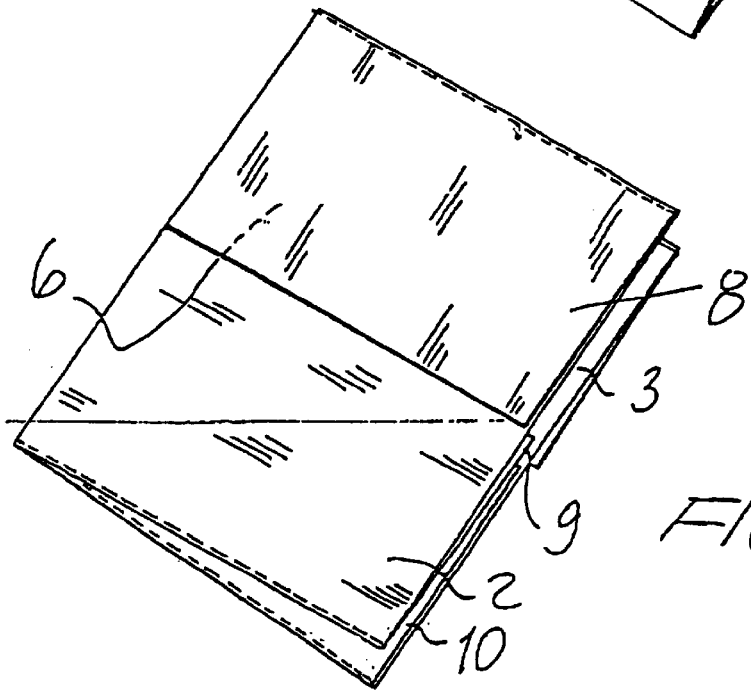
FIG. 7 illustrates the base page of FIG. 6 in a folded position.

Each module 2 can be produced in an extremely simple way, as illustrated in particular in FIGS. 5 and 7, in other words beginning with a single basic page 12 having a height and width substantially equal to about double the height and width of the pages of the diary to be produced.

Successively, a portion situated in correspondence with the extremity of the lower side of page 12, with a height about equal half that of the pages of the diary to be produced, is folded in superimposition on one of the sides of base page 12. A portion situated in correspondence with the upper side of base page 12, also of a height equal to about half that of the pages of the diary to be produced, is folded in superimposition on the other side of base page 12.

Successively, base page 12 is re-folded along the middle line of fold 13 in such a way as to be sub-divided into two parts. The refolded portion starting from the lower side of base page 12 is on the inside while the other portion, refolded starting from the upper side of base page 12, is turned toward the external.

In practice, base page 12, refolded in this way, constitutes, in its entirety, a module 2 with the relative supplementary portions 8, 9, 10 and 11.

The various modules 2, produced in this way, are therefore subjected to a binding process and trimmed in correspondence with their upper and lower edges.

The trimming operation frees the supplementary portions 8, 9, 10 and 11, to the exclusion of the bound area.

From that which has been previously described and from an analysis of the various figures of the design attached, it is clear that the invention achieves its proposed objectives.

In particular, it should be noted that an easy-to-use diary is created, in as much that the same enables the immediate visualization of the week's commitments carried schematically in the weekly structured parts and, at the same time, to have available a greater amount of space for more detailed notes in the areas structured in the daily manner.

A further advantage of the diary, according to the invention, is that each module is of a uniform thickness, in spite of the presence of the supplementary portions.

In practice, the materials used, as well as their dimensions, can be of any type, according to need.

What is claimed is:

1. A diary with high practicality of use comprising a plurality of modules each of which is formed of a folded and trimmed single page, said modules being bound together to form said diary, each module being subdivided into two parts which have note space structured in a weekly and daily manner, each module comprising supplementary portions bound with said parts in such a way as to define further daily note space, said supplementary portions being superimposable on opposed sides of each module, the supplementary portions of each module being formed from said folded and trimmed single page, each module and relative supplementary portion being derived by folding and trimming a single base page of a height and width equal to about double the height and width of a page of the module.

2. The diary of claim 1 in which successive weekly note space in the diary alternates between upper and lower positions in the diary.

3. A method of forming a diary with modules having note space structured in a weekly and daily manner comprising forming modules by: (a) folding a single base page of a height and width equal to about double the height and width of pages of the module, said base page having an upper edge, a lower edge and opposed side edges, said base page being folded such that the upper edge and lower edge are juxtaposed at a median position of said base page with the upper edge and lower edge being on opposed sides of said base page, (b) folding said base page such that one side edge is aligned with the other side edge, and (c) trimming along the lower and upper edges to form supplementary pages.

4. The method of claim 3 in which the modules are bound so as to form the diary prior to the trimming of step (c).

* * * * *